United States Patent [19]

Overton

[11] 4,200,953

[45] May 6, 1980

[54] SURFACE SWEEPER WITH FLOATING BROOM CHAMBER

[75] Inventor: Billy J. Overton, Laquinta, Calif.

[73] Assignee: FMC Corporation, San Jose, Calif.

[21] Appl. No.: 948,846

[22] Filed: Oct. 5, 1978

[51] Int. Cl.[2] ..... A47L 5/30

[52] U.S. Cl. ..... 15/349; 15/83; 15/340; 15/359

[58] Field of Search ..... 15/49 C, 82, 83, 84, 15/85, 86, 347, 348, 349, 354, 355, 356, 359, 340

[56] References Cited

U.S. PATENT DOCUMENTS

| | | | |
|---|---|---|---|
| 982,570 | 1/1911 | Brooks | 15/83 |
| 1,286,481 | 12/1918 | Woodin | 15/82 |
| 1,904,881 | 4/1933 | Presbrey | 15/82 |
| 2,156,065 | 8/1939 | Royer | 15/82 |
| 2,448,328 | 8/1948 | Russell | 15/83 |
| 3,006,021 | 10/1961 | Patch | 15/83 X |
| 3,112,593 | 12/1963 | Ronning | 56/14.4 |
| 3,189,931 | 6/1965 | Peabody | 15/83 X |
| 3,584,325 | 6/1971 | Larsen et al. | 15/83 |
| 4,007,026 | 2/1977 | Groh | 15/352 X |
| 4,041,567 | 8/1977 | Burgoon | 15/83 X |

*Primary Examiner*—Christopher K. Moore

*Attorney, Agent, or Firm*—R. S. Kelly; H. M. Stanley; J. F. Verhoeven

[57] ABSTRACT

A maneuverable surface sweeper has a framework supporting a hopper configured to receive dust and debris swept from an underlying surface. A broom chamber is mounted within the framework overlying the surface to be swept and in communication with the hopper. The broom chamber may move vertically relative to the framework. A rotary driven broom is mounted in the broom chamber and has limited vertical movement capability relative to the chamber. A resilient tubular seal is disposed between the broom chamber and the hopper so that dust control is obtained therebetween while the broom chamber undergoes vertical movement. A bump encountered on the underlying surface elevates the broom chamber permitting the sweeper to pass thereover while allowing the broom to descend and continue in sweeping contact with the surface.

13 Claims, 3 Drawing Figures

SURFACE SWEEPER WITH FLOATING BROOM CHAMBER

BACKGROUND OF THE INVENTION

1. Field of the Invention

The apparatus disclosed herein relates to mechanical broom sweepers and more particularly to such sweepers which have the capability of sweeping over irregularities on the swept surface while maintaining sweeping contact with the surface.

2. Description of the Prior Art

A power driven sweeping machine is disclosed in U.S. Pat. No. 2,448,328, issued to A. Russell, in which a machine body portion contains a forwardly located debris receiving bin. The body portion has a forwardly located towing arm attached thereto and a set of rear supporting wheels so that it may be towed behind a suitable tractor. Under the body portion a brush housing is supported on a forwardly located pivot and a number of rearwardly located depending support arms. The support arms include coil springs which absorb the shocks imparted to the brush housing. A series of sprocket chains are coupled between the rear supporting wheels and a pair of sweeping brushes which are mounted on shafts supported between the side walls of the brush housing. When the body portion is towed in a forward direction, the rotation of the rear support wheels causes the sweeping brushes to rotate and to thereby sweep an underlying surface. One of the brushes clears debris off of the underlying surface and elevates the debris to the second brush which in turn sweeps the debris toward the debris receiving bin within the body portion.

A street sweeper is disclosed in U.S. Pat. No. 982,570, issued to C. C. Brooks, which sweeper includes a casing supported on members depending from a framework. The depending members include coil springs which allow the casing to move in a vertical direction relative to the framework. A number of brushes are driven by a chain drive which is coupled to the drive wheels on the framework of the sweeper. The brushes are mounted within the casing on shafts which extend between journals disposed in the side walls of the casing. The casing and brush assembly may move vertically against the yielding coil springs to compensate for uneven characteristics in the underlying surface being swept.

U.S. Pat. No. 1,286,481, issued to N. C. Woodin, discloses a broom support for a street sweeper wherein a broom having an overlying hood is driven through a chain drive. The broom is mounted on a shaft extending between two broom support arms. The broom is movable in a vertical direction as the support arms are pivoted about a transverse pivot shaft connecting the broom's support arms together behind the broom. A spring is provided which is positioned above the broom and the hood and is coupled to the ends of the broom shaft for the purpose of absorbing shock imposed upon the system due to sudden downward broom movement.

A sweeping machine is disclosed in the O. F. Presbrey U.S. Pat. No. 1,904,881, in which a rotary broom is mounted forward of a mobile vehicle and is supported by a cable system attached to the vehicle. Raising and lowering of the broom is accomplished by manipulation of the cable system and the broom is said to be in a freely floating condition in front of the vehicle as the supporting cable for the broom is maintained in a taut condition at all times during operation by a pair of coiled tension springs. The entire broom assembly in the Presbrey patent may move vertically, or one end may move vertically independent of the other end so that the broom follows the topography of the underlying surface being swept.

Another sweeping machine is disclosed in the J. R. Royer U.S. Pat. No. 2,156,065. A sweeping machine arranged to be towed by another vehicle is configured so that two rotary brooms are mounted underneath the machine, each of which is capable of independent vertical motion relative to the framework of the machine. A motor is provided for driving the two brooms through appropriate chain and sprocket linkage. Dirt deflectors are mounted adjacent to the upper periphery of the brooms and move vertically therewith. A coiled tension spring is coupled between the framework and the structure supporting the brooms so that the brooms are suspended resiliently beneath the frame and may therefore ride upwardly and over projections on the surface being swept.

Another surface sweeper is disclosed in U.S. Pat. No. 4,007,026, issued to A. F. Groh. An industrial sweeper contains a hopper supported on the sweeper framework. A dust filter configured as a number of rows of cartridges having pleated paper filter elements is located within the hopper between a dust laden air portion of the hopper and a filtered air portion. The filters are cyclically cleaned by the application of reverse air jet pulses. The cleaning is performed in only a portion of the filters at any one time. A broom chamber is rigidly affixed to the framework containing a rotating broom which is disposed to engage an underlying surface to be swept. The broom is movable vertically within the broom chamber over a limited distance and serves to sweep debris and dust from the underlying surface toward an elevator paddle which urges the dust and debris through aligned apertures in the broom chamber and the hopper so that the dust and debris is collected within the hopper. A blower exhausts air from the filtered air portion of the hopper, thereby drawing an airflow along a path from the underlying surface into the broom chamber, into the dust laden air portion of the hopper, to the filter and the filtered air portion of the hopper and to the atmosphere. While the Groh device will accommodate small irregularities in the surface being swept, it will not sweep continuously and afford good dust control when encountering large irregularities in the underlying surface, such as parking lot speed bumps.

SUMMARY OF THE INVENTION

In accordance with the present invention a framework is provided in a mobile sweeper which supports a hopper configured to receive dust and debris. A floating broom chamber is provided together with means for mounting the floating broom chamber on the framework so that it is movable vertically relative to the chamber. A broom is mounted within the floating broom chamber for contacting the underlying surface, and means is provided for mounting the broom within the broom chamber in a manner to provide limited vertical movement between the broom and the chamber. Dust and debris which is swept off of the surface by the broom in the floating broom chamber is thereafter directed from the floating broom chamber into the hopper. Thus, by providing both a movable broom chamber (with respect to the frame) and a movable broom (with respect to the chamber) the sweeper can traverse relatively large obstacles, such as speed bumps, while the broom remains in continuous sweeping contact with the underlying surface.

In a preferred form of the invention a resilient tubular seal is disposed between the hopper and the floating broom chamber. The tubular seal is collapsible across the diameter thereof so that the floating broom chamber may be moved upward from the down position while maintaining the seal between the broom chamber and the hopper so that all dust which is swept up by the broom will be delivered to the hopper.

BRIEF DESCRIPTION OF THE DRAWINGS

FIG. 3 is an enlarged partial longitudinal section taken along a plane parallel to the fore and aft axis of the industrial sweeper of FIG. 1.

DESCRIPTION OF THE PREFERRED EMBODIMENT

Figure 1:
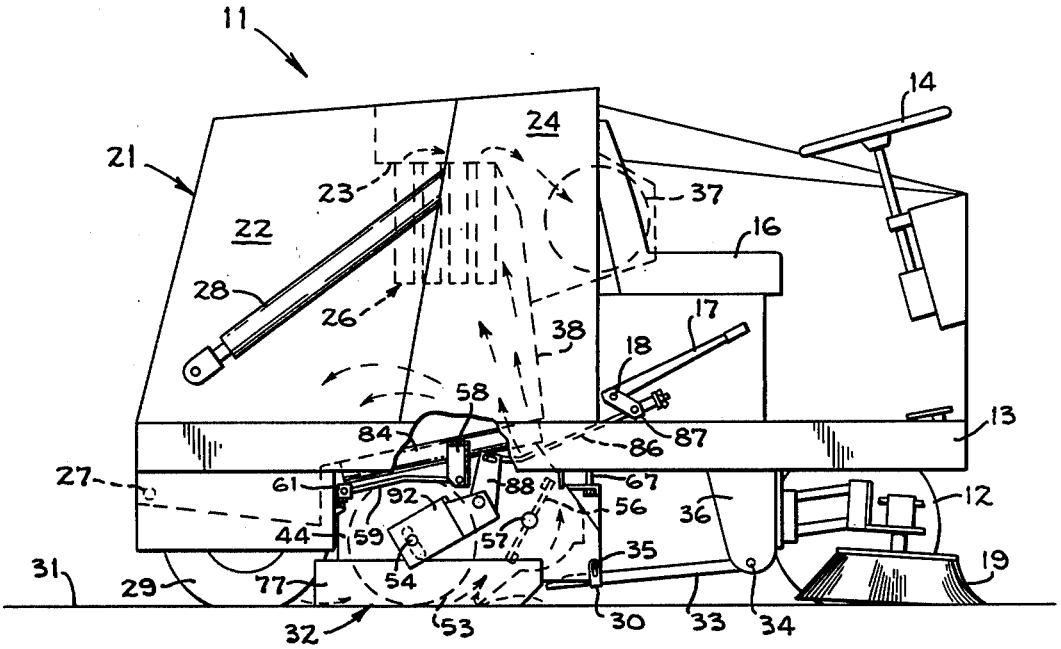
FIG. 1 is a side elevational view of an industrial sweeper embodying the floating broom chamber of the present invention.

An industrial type sweeper 11 is shown in FIG. 1 which is of the general type described in detail in U.S. Pat. No. 4,007,026 to A. F. Groh. As described therein, the sweeper is of the driven front wheel type wherein one centrally located front wheel 12 is mounted for pivotal movement within a framework 13. The front wheel is controlled through appropriate linkage and gearing by a steering wheel 14 as described in the Groh specification. An operator's seat 16 is located behind the steering wheel together with appropriate controls for operating the various components of the sweeper. One of the controls is seen in FIG. 1 as a broom elevation control handle 17 which pivots about a pivot point 18 in the framework when raised or lowered by a sweeper operator. A curb or side brush 19 is also provided which may be raised or lowered by the operator as discussed in the Groh patent, such mechanism being unrelated to the invention described herein.

A hopper 21, configured to receive dust and debris, is mounted on the framework 13 toward the rear thereof. The hopper has a dust laden air chamber 22 therein separated by an internal wall 23 from a filtered air chamber 24. An array of filters 26 is disposed between the chambers 22 and 24 mounted in the wall 23 as described in the Groh patent. The hopper is mounted on the framework 13 for pivotal motion relative thereto about a pivot point 27 at the rear end of the framework. The hopper is pivoted about the pivot point 27 through the actuation of a hydraulic piston and cylinder combination 28, one such assembly being located on each side of the hopper 21. A rear door (not shown) is provided in the rear wall of the hopper so that dust and debris may be dumped therefrom when the hopper is pivoted rearwardly about the pivot point by the hydraulic piston and cylinder assemblies.

A pair of rear supporting wheels 29 is located at the rear of the sweeper 11 supporting the framework 13 above an underlying surface 31 which is to be swept. A floating broom chamber shown generally at 32 is supported beneath the hopper 21 in a position immediately overlying the surface 31. A crusher plate 33 is located immediately forward of the floating broom chamber, being pivoted at the forward end thereof at a pivot point 34 in a member 36 depending from the framework 13. The crusher plate has a slotted ear 30 attached to each side thereof. A guide pin 35 extends from each side of the broom chamber passing through the slot in the ear 30. The guide pins and slotted ears serve to support the rear end of the crusher plate above the surface 31 and provide limited independent upward pivotal motion of the crusher plate relative to the broom chamber.

The broom chamber 32 may be seen to admit air, shown by the dashed arrows in FIG. 1, underneath depending flaps 77 attached thereto into the interior of the floating broom chamber. The air follows a flow passage through the broom chamber, into the dust laden air chamber 22 of the hopper 21, through the filter array 26 and into the filtered air chamber 24. The air is caused to flow along the flow passage by the operation of a blower 37 which exhausts the air from the filtered air chamber 24 to the atmosphere. A vacuum of 0.3 to 0.4 inches of mercury is induced in the hopper by the blower which has been found to be sufficient for operation of industrial sweepers of the type described herein.

Turning now to FIG. 3, the manner in which the floating broom chamber 32 is mounted in the framework 13 is there shown. The hopper 21 has a generally vertical front wall portion 38 on the lower end of which is mounted a baffle channel 39 which overlies a portion of an aperture 41 through an inclined bottom wall portion 42. The baffle channel 39 protects the filter array 26 from direct impingement by debris being flung into the dust laden air chamber 22 of the hopper. The bottom wall of the hopper also has a V-shaped depending channel 43 attached thereto that deflects dust and debris that might otherwise be flung back into the rear portion of the floating broom chamber 32.

The floating broom chamber includes a broom housing 44 having two side walls 46, a rear wall 47, a front wall 48 and an opening 49 in a top wall 51. The opening in the top wall of the broom housing 44 may be seen to be aligned, or in registration with, the aperture 41 in the bottom wall portion 42 of the hopper 21. An elevator arch 52 is shown attached to the front wall of the broom housing 44.

A broom 53 having a drive shaft 54 running therethrough is shown disposed within the broom housing 44 (FIG. 3) with the drive shaft running transversely across the broom housing. The broom drive shaft is driven by means such as a hydraulic motor 55 (FIG. 3) mounted directly on the end of the drive shaft and movable therewith. The broom 53 is driven in the counterclockwise direction as seen in FIG. 3, thereby functioning as an "underthrow" type of a sweeping broom. An elevator paddle assembly 56 is shown mounted on an elevator drive shaft 57 forward of the broom 53. The elevator paddle assembly is driven by the elevator drive shaft also in a counterclockwise direction by an appropriate motor such as a hydraulic motor 60 mounted directly to the side wall of the broom chamber and movable therewith. The periphery of the elevator paddle assembly 56 passes close to the inner surface of the elevator arch 52, thereby urging dust and debris to be swept upwardly within the broom housing 44 through the exit opening 49 in the broom housing and through the inlet opening 41 in the hopper.

A pair of angles 58 (FIG. 2) are attached to the framework 13 at opposite sides of the broom chamber 32. Each angle 58 includes a bar 59 pivotally attached thereto and extending rearwardly. A bracket 61 is fixed to each side wall 46 on the broom housing 44 near the rear end thereof. The bracket 61 is configured to accept the rear end of the associated bar 59 for pivotal motion therein. Each bar 59 therefore forms a link operating to pull or tow the broom housing 44 along with the framework 13. A pair of rear stop brackets 62 are affixed to a vertical wall 63 on the framework 13 disposed behind the broom housing 44. An adjustable rear stop bolt 64 passes through an opening in each rear stop bracket and is locked in place by means of a nut 66. Each rear stop bolt 64 contacts the underside of the bracket 61 on the adjacent side of the broom housing, thereby supporting the rearward end of the broom housing 44 in a down position.

The front wall 48 of the broom housing 44 (FIG. 3) has a hole therein through which is passed a front stop bolt 67. A flange 68 on a channel member 98 of the framework 13 has a through hole which accepts the shank of the front stop bolt 67. The end of the front stop bolt has threads which receive a pair of stop lock nuts 69 which rest against the upper surface of the flange 68, thereby adjustably supporting the front end of the broom housing 44 in a down position. The crusher plate 33 has an upwardly extending land 71 thereon. An angle 72 extending from the outer surface of the elevator arch 52 has a threaded hole therein which accepts a lift point bolt 73. The lift point bolt is locked in place by a pair of lock nuts 74.

It may be seen in FIG. 3 that the underside of the broom housing 44 is spaced above the underlying surface 31. A flexible front flap 76 is attached to the broom housing at the lower end of the elevator arch 52 and extends to the underlying surface. The flexible side flaps 77 depend from the side walls 46 of the broom housing to a position proximate to the underlying surface. A flexible rear flap 78 is mounted to depend from the rear wall 47 of the broom housing toward the underlying surface. Also mounted at the bottom of the rear wall of the broom housing is a brush strip 79 which forms a rear broom arch extension and serves to dislodge debris from the brush 53 so that it may be re-engaged and swept forwardly into the broom chamber formed by the broom housing. As the periphery of the broom 53 wears away due to contact with surfaces being swept, the rear broom arch extension 79 requires adjustment toward the periphery of the rotating broom. This adjustment is obtained by means of an adjustment bolt 81 having a set of lock nuts 82 threaded thereon. The adjustment bolt is capable of being selectively positioned fore and aft as it passes through a threaded hole in an adjustment flange 83. Positioning of the adjustment bolt forwardly pushes the rear broom arch extension brush strip forward to a position where it properly engages the periphery of the broom 53 for the purpose hereinabove described.

Figure 2:
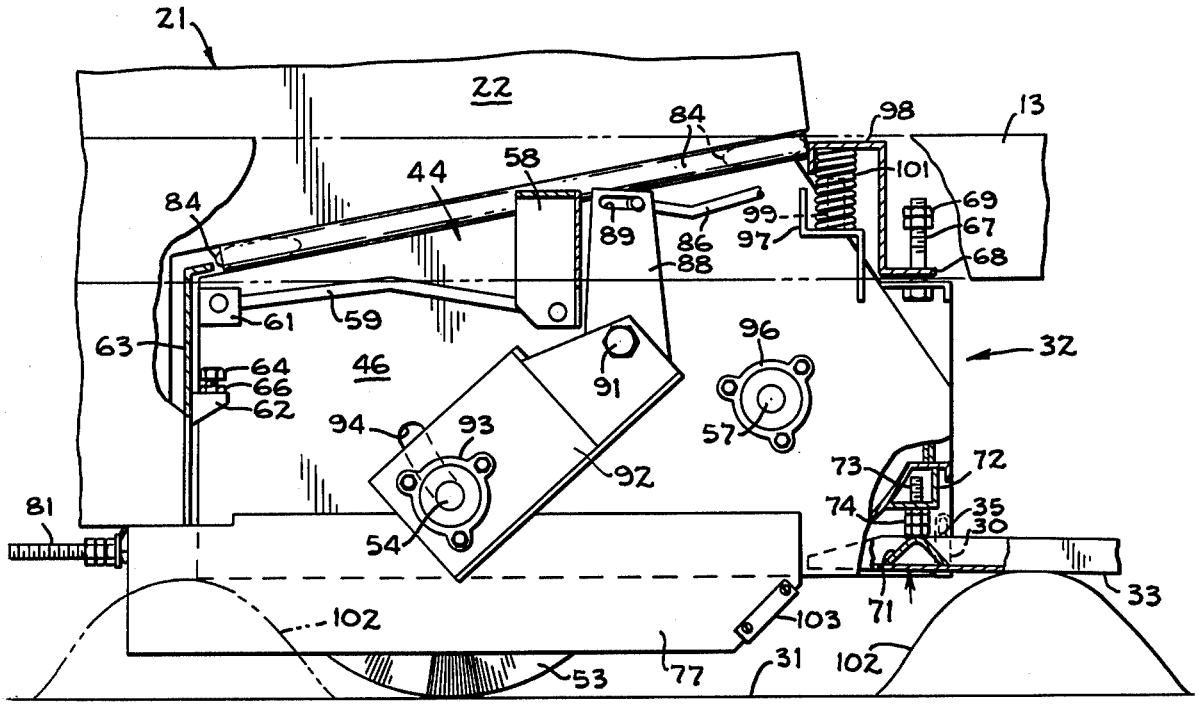
FIG. 2 is an enlarged partial side elevational view of the industrial sweeper of FIG. 1 with portions thereof being broken away.
Figure 4:
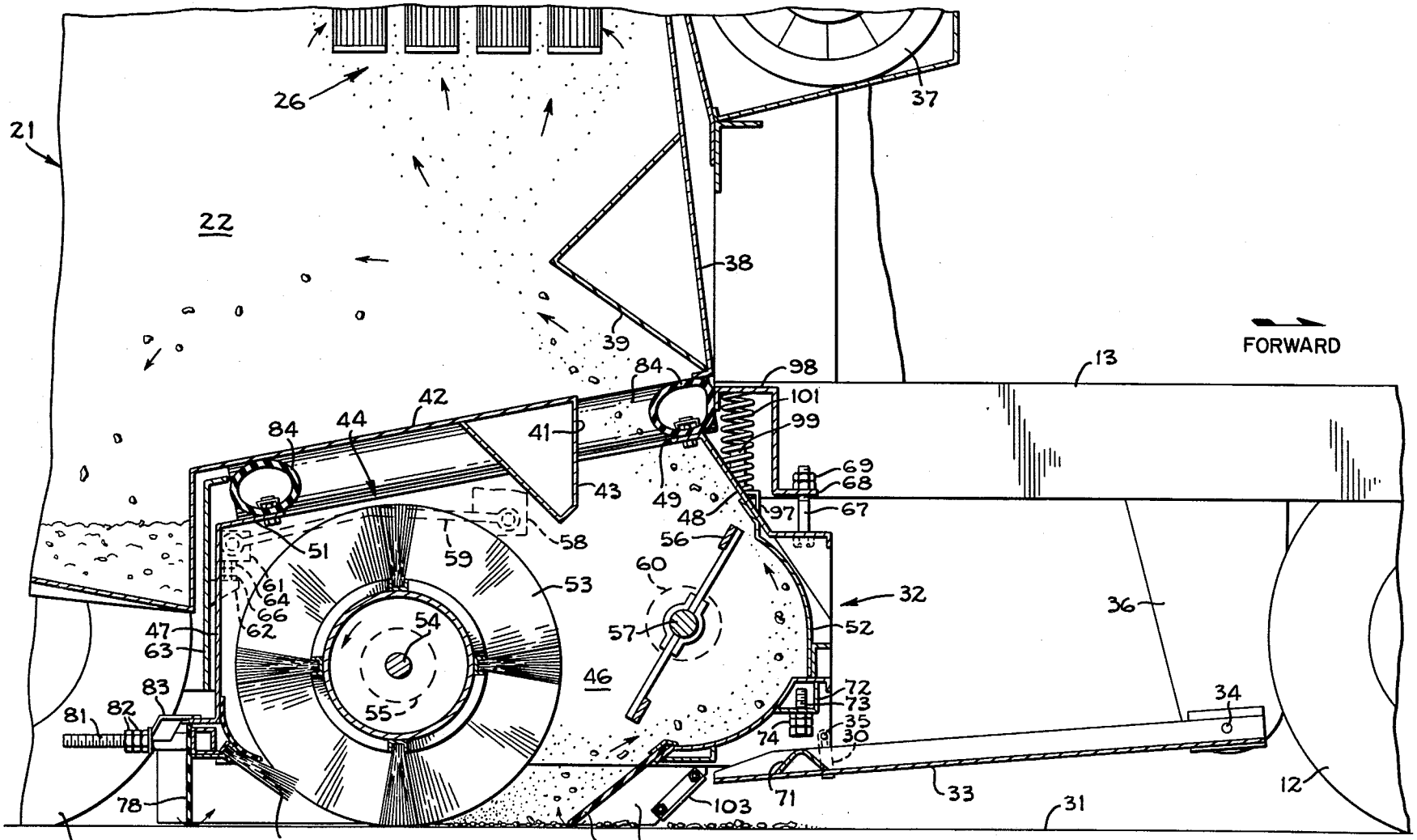

A resilient tubular seal 84 is secured by a plurality of spaced bolts to the top wall 51 of the broom housing 44 surrounding the opening 49 therein. The resilient tubular seal therefore also surrounds the inlet aperture 41 in the bottom wall 42 of the hopper 21. As seen in FIG. 3, the upper edge of the tubular seal 84 engages the bottom wall 42 of the hopper when the hopper is in its normal, operative position and when the broom chamber is in its lowermost position so as to provide a seal between the hopper and the broom chamber, it being recognized that the hopper is supported in its lowermost FIG. 3 position by portions of the framework 13 (not shown). As a consequence, air which is drawn in underneath the flexible flaps 76, 77 and 78 entrains the dust and debris swept into the interior of the broom housing 44 and, together with the inertia imparted by the rotating broom 53, carries the dust and debris into the path of the elevator paddles 56. The elevator paddles working in conjunction with the elevator arch 52 further elevate the dust and debris within the broom housing 44 flinging it through the exit opening 49 and the inlet opening 41 into the dust laden air chamber 22 in the hopper 21. Heavier debris may be seen to fall toward the rear of the hopper while the lighter dust particles are still entrained in the airflow travelling toward the filter array 26. The airflow through the flow passage is sustained by the blower 37, as hereinbefore described. Therefore, good dust control is obtained at the underlying surface 31 being swept and substantially no debris or dust particles are allowed to pass the resilient collapsible tubular seal 84 as the bottom wall 42 of the hopper engages the upper surface of the seal and the top wall 51 of the broom housing is in secured engagement with the bottom surface of the seal. The crusher plate 33 serves to crush cans and break bottles into fragments before they pass under the front flexible flap 76 to be swept forwardly and upwardly into the broom housing. The crusher plate also serves as the means for elevating the broom housing when the sweeper passes over a large obstacle, as shown in FIG. 2 and as will be explained in greater detail hereinafter. The broom 53, being free to undergo limited relative vertical movement in the broom housing 44, maintains contact with the underlying surface being swept as it moves vertically relative to the broom housing and the framework to accommodate small undulations in the underlying surface.

Returning momentarily to FIG. 1 a broom lift rod 86 is shown engaged by a link 87 actuated by the broom elevation handle 17. As seen in FIG. 2, the broom lift rod 86 at one side of the housing 44 engages an upper broom lifting link 88 in a slot 89 formed therein. The upper broom lifting link is fixed to a lower broom lifting link 92 upon which is mounted a journal 93 accepting the projecting end of the broom drive shaft 54. Both the upper and lower links 88, 92 are secured to a rod 91 which extends laterally through the broom chamber and which is journalled in the side walls 46 thereby (by means not shown). The motor 55, which drives the broom, is secured to a link (not shown) which is similar to the link 92 and which is secured to the rod 91 at the opposite side of the broom housing. The broom is therefore allowed to traverse through limited vertical movement relative to the broom housing 44 without movement of the broom elevation handle 17 as the slotted link 88 is free to move relative to the broom lift rod 86. At the same time the drive shaft 54 is allowed to traverse slots 94 in each of the side walls 46 for the broom housing, as seen in FIG. 2. Also mounted in the side wall 46 seen in FIG. 2 is a journal 96 which accepts one end of the elevator paddle assembly drive shaft 57.

An angle 97 is shown (FIGS. 2 and 3) attached to each side of the broom housing 44. A section of channel 98 on which the flange 68 is formed is attached to the framework 13 overlying the angle 97. A locating pin 99 is mounted on each of the angles 97 and a coiled compression spring 101 is positioned to surround each locating pin and to be captured between the angle 97 and the channel 98. The locating pin 99 may best be seen in FIG. 3 where the floating broom chamber 32 is in its normal, lowered position subjecting the spring to lesser compression.

In FIG. 2 a projection, such as a speed bump 102, is seen extending upwardly from the underlying surface 31 to engage the underside of the crusher plate 33. The land 71 on the crusher plate is shown in engagement with the lift point bolt 73 thereby urging the broom housing 44 away from its downward position. The front stop bolt 67 is shown having traveled upwardly to displace the stop lock nuts 69 from contact with the flange 68. The upward movement of the broom housing 44 causes the tubular seal 84 to collapse transversely as seen in FIG. 2. The broom housing is shown with both the front and rear ends elevated by contact between the speed bump and the pressure plate in FIG. 2 for purposes of illustration only. The broom housing front end is capable of independent vertical movement relative to the rearward end. When the sweeper 11 has advanced to a point where the speed bump 102 underlies the rear portion of the side plates 46, as seen in phantom lines in FIG. 2, the broom housing is elevated to lift the lower surface of each bracket 61 from contact with the associated rear stop bolt 64, as shown. At this time the front end of the broom housing may have begun to return to the down position with the stop lock nuts 69 in contact once again with the flange 68. It should be noted that with the broom housing in the elevated position as seen in FIG. 2, the broom 53 has been lowered relative to the broom housing (with respect to the FIG. 1 position) by motion of the drive shaft 54 in the slot 94 so that the broom is maintained in sweeping contact with the underlying surface. The forward edge of the flexible side flaps 77 are bevelled and carry a metal guard 103 thereon to protect the side flaps from accelerated wear and damage as the edges thereof advance into surface projections such as the speed bump 102.

An industrial sweeper has been disclosed herein having attached thereto a floating broom chamber with a resilient collapsible tubular seal disposed between the broom chamber and a hopper for receiving dust and debris. The broom chamber is normally supported in a down position by down stops between the frame and the broom chamber but is capable of being elevated by large protrusions on the underlying surface being swept. The resilient tubular seal may be rubber or a resilient plastic material and may be of solid or porous construction while maintaining the dust control seal for either the elevated or the down positions or any position therebetween. Dust control is maintained and sweeping contact between the rotating sweeping broom and the underlying surface being swept is also maintained for both the elevated and the down positions of the floating broom chamber.

Although the best mode contemplated for carrying out the present invention has been herein shown and described, it will be apparent that modification and variation may be made without departing from what is regarded to be the subject matter of the invention.

What is claimed is:

1. A mobile sweeper for cleaning an underlying surface including a framework, a hopper mounted on the framework to receive dust and debris, a broom chamber adjacent said underlying surface and in communication with said hopper for transferring said dust and debris from said surface to said hopper, means mounting said broom chamber to said framework to permit relative vertical movement therebetween, a broom within said broom chamber, means for rotating said broom, and means for mounting said broom to said broom chamber so as to permit relative vertical motion therebetween whereby said broom chamber may be elevated to permit the sweeper to traverse obstacles on said underlying surface while said broom is retained in sweeping contact with said underlying surface.

2. A mobile sweeper as set forth in claim 1 including yieldable spring means mounted between said framework and said broom chamber for urging said chamber downwardly.

3. A mobile sweeper as set forth in claim 1 wherein said means for rotating said broom comprises a motor secured directly to the shaft of said broom.

4. A mobile sweeper as set forth in claim 1 wherein said broom chamber is provided with an opening at the upper end thereof and said hopper is provided with an opening arranged in closely spaced relationship with said chamber opening, and flexible sealing means secured between said hopper and chamber in surrounding relationship to said openings.

5. In a surface cleaner for picking up debris and dust particles comprising a vehicle having a framework supporting a hopper divided into a dust laden air chamber and a filtered air chamber, a filter disposed between the chambers, a broom chamber coupled beneath the framework adjacent to the surface being cleaned and in communication with the dust laden air chamber through registered apertures in said dust laden air chamber and said broom chamber, a broom mounted for rotating motion within the broom chamber in sweeping contact with the surface being cleaned and being movable vertically relative to the broom chamber, a blower operating to exhaust air from the filtered air chamber thereby causing air to flow through a flow passage extending from the surface through the broom chamber and the dust laden air chamber and the filter to the filtered air chamber, the improvement wherein a compressible seal is positioned surrounding the registered apertures, and means disposed between the framework and the broom chamber for supporting the broom chamber and for providing limited vertical relative movement therebetween, so that the broom chamber is movable from a downward to an upward position by an underlying bump on the surface being cleaned and the broom remains in sweeping contact with the surface while the integrity of the air flow passage is maintained in both the upward and downward positions.

6. The cleaner of claim 5 wherein said compressible seal comprises a tubular element having resilient walls.

7. The cleaner of claim 5 wherein said means for providing limited vertical relative movement between the framework and broom chamber provides for approximately one and one-half inches of relative movement.

8. The cleaner of claim 5 wherein said means for providing limited vertical relative movement between the framework and broom chamber comprises a front stop on the framework, means mounted on the broom chamber for contacting said front stop at a lower chamber limit, a rear stop on the framework, and means mounted on the broom chamber for contacting said rear stop at a lower chamber limit.

9. The cleaner of claim 8 together with a spring urging the broom chamber onto said front and rear stops.

10. A mobile sweeper for cleaning an underlying surface and having a framework and a hopper mounted on the framework to receive dust and debris through an inlet aperture therein, a floating broom chamber having an outlet aperture, means for mounting said floating broom chamber on said framework with said outlet aperture in registration with the inlet aperture of the hopper and for supporting said floating broom chamber in a down position, a broom adapted for contact with the underlying surface, means for mounting said broom for rotation within said floating broom chamber whereby dust and debris is swept off of the surface into said floating broom chamber, said last named means providing limited vertical movement between said broom and said floating broom chamber, means for urging the swept dust and debris from said floating broom chamber through said outlet and inlet apertures into the hopper, a resilient tubular seal disposed between the hopper and said floating broom chamber surrounding both said outlet and inlet apertures, said tubular seal being transversely collapsible, whereby said floating broom chamber may be moved upward from said down position while said broom is retained in contact with the underlying surface so that the surface is swept substantially continuously during operation.

11. A mobile sweeper as in claim 10 wherein said means for supporting comprises a front stop and a rear stop on the framework, said front and rear stops operating independently whereby the front and rear of said floating broom chamber are elevated independently by a bump on the underlying surface.

12. A mobile sweeper as in claim 10 together with a spring urging said floating broom chamber toward said down position.

13. A mobile sweeper as in claim 10 wherein said means for urging swept dust and debris includes an elevator paddle wheel mounted for rotating movement within said floating broom chamber, whereby the dust and debris is engaged thereby and elevated from said broom chamber to the hopper.

* * * * *